United States Patent [19]

Verhoeven et al.

[11] Patent Number: 4,770,718

[45] Date of Patent: Sep. 13, 1988

[54] METHOD OF PREPARING COPPER-DENDRITIC COMPOSITE ALLOYS FOR MECHANICAL REDUCTION

[75] Inventors: John D. Verhoeven; Edwin D. Gibson; Frederick A. Schmidt; William A. Spitzig, all of Ames, Iowa

[73] Assignee: Iowa State University Research Foundation, Inc., Ames, Iowa

[21] Appl. No.: 112,678

[22] Filed: Oct. 23, 1987

[51] Int. Cl.[4] ..... B22F 3/00; B22F 9/08

[52] U.S. Cl. ..... 148/11.5 P; 75/0.5 B; 75/0.5 C; 264/12; 419/66; 419/67; 419/68; 419/69

[58] Field of Search ..... 75/0.5 C, 0.5 B; 148/11.5 P; 419/66, 67, 68, 69; 264/12

[56] References Cited

U.S. PATENT DOCUMENTS

| | | | |
|---|---|---|---|
| 2,273,832 | 2/1942 | Carney | 75/0.5 C |
| 4,170,466 | 10/1979 | Klar | 75/0.5 C |
| 4,378,330 | 3/1983 | Verhoeven et al. | 148/11.5 Q |
| 4,481,030 | 11/1984 | Schmidt et al. | 75/84 |

OTHER PUBLICATIONS

Bevk et al. (1982), "In Situ Composites IV", Ed. Lempket et al., Elsevier Sci. Publ. Co., pp. 121–133.

Downing et al., (1987), J. Appl. Phys. 61:2621–2625.

Foner (1982), Prog. Powder Met. 38:107–114.

Bevk et al. (1978), J. Appl. Phys. 49:6031–6038.

Verhoeven et al. (1986), J. Metals, Sep. issue, pp. 20–24.

Metals Handbook, vol. 7, "Powder Metallurgy", 9th ed. (1984), pp. 25–39.

*Primary Examiner*—Wayland Stallard

*Attorney, Agent, or Firm*—Tilton, Fallon, Lungmus & Chestnut

[57] ABSTRACT

Copper-dendritic composite alloys are prepared for mechanical reduction to increase tensile strength by dispersing molten droplets of the composite alloy into an inert gas; solidifying the droplets in the form of minute spheres or platelets; and compacting a mass of the spheres or platelets into an integrated body. The spheres preferably have diameters of from 50 to 2000 μm, and the platelets thicknesses of 100 to 2000 μm. The resulting spheres or platelets will contain ultra-fine dendrites which produce higher strengths on mechanical reduction of the bodies formed therefrom, or comparable strengths at lower reduction values. The method is applicable to alloys of copper with vanadium, niobium, tantalum, chromium, molybdenum, tungsten, iron and cobalt.

14 Claims, 3 Drawing Sheets

METHOD OF PREPARING COPPER-DENDRITIC COMPOSITE ALLOYS FOR MECHANICAL REDUCTION

CONTRACTUAL ORIGIN OF THE INVENTION

The U.S. Government has rights in this invention pursuant to Contract No. W-7405-ENG-82 between the U.S. Department of Energy and Iowa State University, Ames, Iowa.

FIELD OF INVENTION

The field of this invention is alloys of copper with metals forming a dendritic phase, and the mechanical reduction of such composite alloys to obtain increased tensile strength.

BACKGROUND OF INVENTION

Because of its electrical and heat conducting properties, copper has many important uses in the form of wire, sheet, etc. However, pure copper has relatively weak tensile strength. One promising approach to improving the strength of copper is alloying it with a metal which forms a dendritic phase in the copper matrix. Such multi-phase copper alloy mixtures have been referred to as "in-situ" composites. The alloying metal is present as an array of dendrites.

It has been demonstrated that quite high strength copper-dendritic alloys can be produced by alloying copper with elements such as niobium, vanadium, or iron. See Bevk et al. (1978); and Bevk, et al. (1982). High strength sheets or wires may be fabricated by a casting and mechanical reduction process. The casting is first produced as a microstructure of X dendrites in a Cu matrix, and the alloy is then mechanically reduced by either rolling or drawing operations. This kind of mechanically worked copper composite alloy is described by Downing, et al. (1987), and Verhoeven, et al. U.S. Pat. No. 4,378,330.

Cu-X dendrite type alloys are quite ductile and may be mechanically reduced to very large drawing strains without breakage. Mechanical reduction, such as by drawing, extrusion, or rolling, converts the X dendrites into elongated filaments, which serve to reinforce and greatly increase the strength of the formed wire, sheet, or other configuration.

In the development of this copper-dendrite technology for practical use, a problem has arisen which remains to be resolved. As the reduction in area ratio, $A_o/A$ (where $A_o$=original area and A =final area) is increased the strength of the alloy is observed to increase. However, wire diameters for the highest strengths are extremely small, such as 25 mm (0.001 inch).

Reduced strengths with larger size ingots for a given $A_o/A$ value result because the dendrite size in the larger ingot is increased. For example, the dendrite size in the 15 gm ingots of Bevk (1982) was about 2 μm compared to 7 μm in the larger ingot. Ultimate tensile strengths correlate approximately with $S^{-0.5}$, where S is the spacing of the X filaments produced from the X dendrites in the casting. Consequently, for a given composition of the X component, the dendrite spacing will inherently increase as the casting size increases because of the reduced solidification rates required with the lower surface to volume ratio of larger sized ingots. For scale up to larger sized ingots, therefore, the ingots need to have larger $A_o/A$ values to achieve comparable strengths to the smaller ingots. Heretofore, however, no method has been known for overcoming this limitation.

SUMMARY OF INVENTION

The present invention comprises a new method of preparing copper-dendritic composite metal alloys for mechanical reduction, and thereby to increase tensile strength. The method has particular application to preparing high tensile strength copper wire, but can also be used for preparing copper sheet or other copper forms.

The method is carried out by dispersing molten droplets of the composite alloy into an inert gas such as argon. The dispersed droplets are solidified to particles such as spheres or platelets. The solidified particles have sizes corresponding to the droplet sizes. If the size of the droplets or platelets as produced is not sufficiently uniform, the particles may be sorted by size. The spheres or platelets as produced, or as size-selected, are compacted to form integrated bodies ready for mechanical reduction by drawing or rolling.

Because the droplets produced by the gas dispersion step can be frozen at a rapid rate, (viz. by solidification while gas-borne or by impingement on a cool surface), the resulting spheres or platelets will contain ultra-fine dendrites. By consolidating the spheres or platelets, larger diameter bodies can be formed with finer dendrite structures. High tensile strengths are therefore obtainable by mechanical reduction at lower $A_o/A$ values. The result is that larger size wire or sheet can be produced while obtaining maximized strengths.

THE DRAWINGS

In illustrating the present invention, reference may be had to the accompanying drawings in which.

DETAILED DESCRIPTION

The method of this invention may be practiced with any copper-dendritic composite alloy. Such alloys when initially formed and cast are composed of a copper matrix in which there is a dispersed, solid solution phase of dendrites of the alloying metal. Metals that are particularly suitable for forming such composite alloys include vanadium, niobium, tantalum, chromium, molybdenum, tungsten, iron, and cobalt. Such alloys may be formed by conventional melting, fusing and casting procedures. Verhoeven et al. U.S. Pat. No. 4,378,330 describes a Cu-Nb alloy which is representative of this class of in-situ or composite alloys. One or more of the above-listed dendrite forming metals can be substituted for the niobium as described in the cited patent.

As an alternative to conventional melting or casting, the alloy may be formed by a consumable arc melting method, as described in Verhoeven et al. U.S. Pat. No. 4,481,030. In that process, a consumable electrode is prepared which has a copper matrix with a plurality of the dendrite-forming "X" metal strips embedded therein. The electrode is subjected to direct current arc melting in an enclosed chamber containing an inert gas (e.g., argon). Reduced gas pressures, such as about $\frac{2}{3}$ atmosphere, can be employed for most of the dendritic metals. However, more refractory high melting point metals, superatmospheric pressure may be used as described in Verhoeven, et al. (1986). The elevated pressure process is advantageous for forming alloys of copper with molybdenum and/or tungsten. The inert gas pressure around the electrode should be sufficient to suppress boiling of liquid copper at the liquidus temperature of the alloy being produced.

Figure 1:
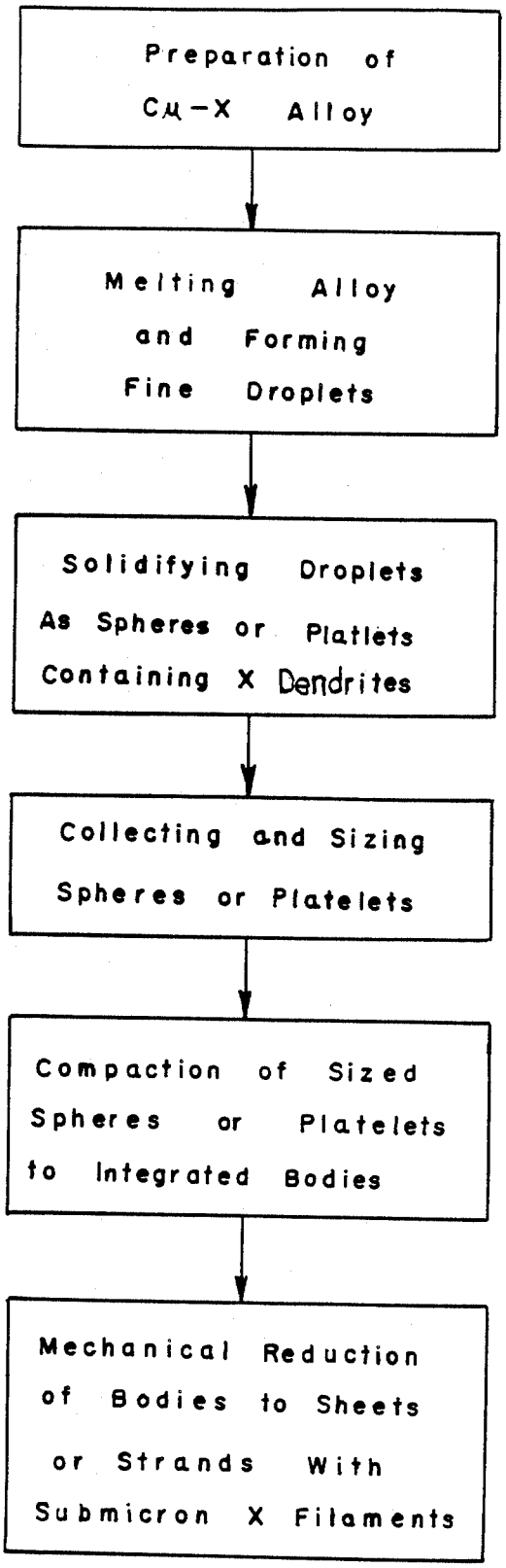
FIG. 1 is a block flow sheet illustrating the general steps of the method in its generic aspect.

In practicing the present invention, as indicated by the flow sheet of FIG. 1, after the Cu-X alloy has been prepared it is melted and formed into fine droplets. This operation is carried out within an enclosed chamber containing an inert gas atmosphere (viz. argon or helium). The molten droplets are dispersed into the inert gas. Droplets are rapidly solidified either while gas-borne or by impingement on a cooled surface. When the droplets are solidified while gas-borne they will have a generally spherical shape. If solidified by surface impingement, the solidified particles will have a flattened, wafer-like shape, referred to herein as "platelets". Particle sizes may be controlled by selecting the method and conditions of dispersement. For example, gas jet atomization or electrode sputtering may be used to produce the dispersed droplets. It is preferred to form droplets having average sizes in the range from about 50 μm to 2000 μm. Alternatively or additionally, the solidified particles (spheres or platelets) can be subjected to size sorting and oversize or undersize particles can be eliminated.

In the next step of the process, a mass, comprising a loose body, of the spheres or platelets is compacted into an integrated body. For example, size-selected particles may be formed into a cylindrical shape. In this step, bonding is obtained between the copper surfaces of the particles. Integration at a low temperature is preferred to avoid possible coarsening of the dendrite phase. Generally suitable compaction processes include packing the particles into a cylinder form by pressing in a die and/or cold isostatic pressing. A suitable procedure is described by Foner (1982), the particles being introduced into a cylindrical copper container and subjected to compaction by extrusion of the container.

The compacted bodies may be in the form of billets ready for mechanical reduction processing. Such billets can be processed by any mechanical size reduction process, including rotary forging, rod rolling, swaging, or drawing. Such processing is carried out as previously described. (See, for example, Verhoeven, et al. U.S. Pat. No. 4,378,330.)

Figure 2:
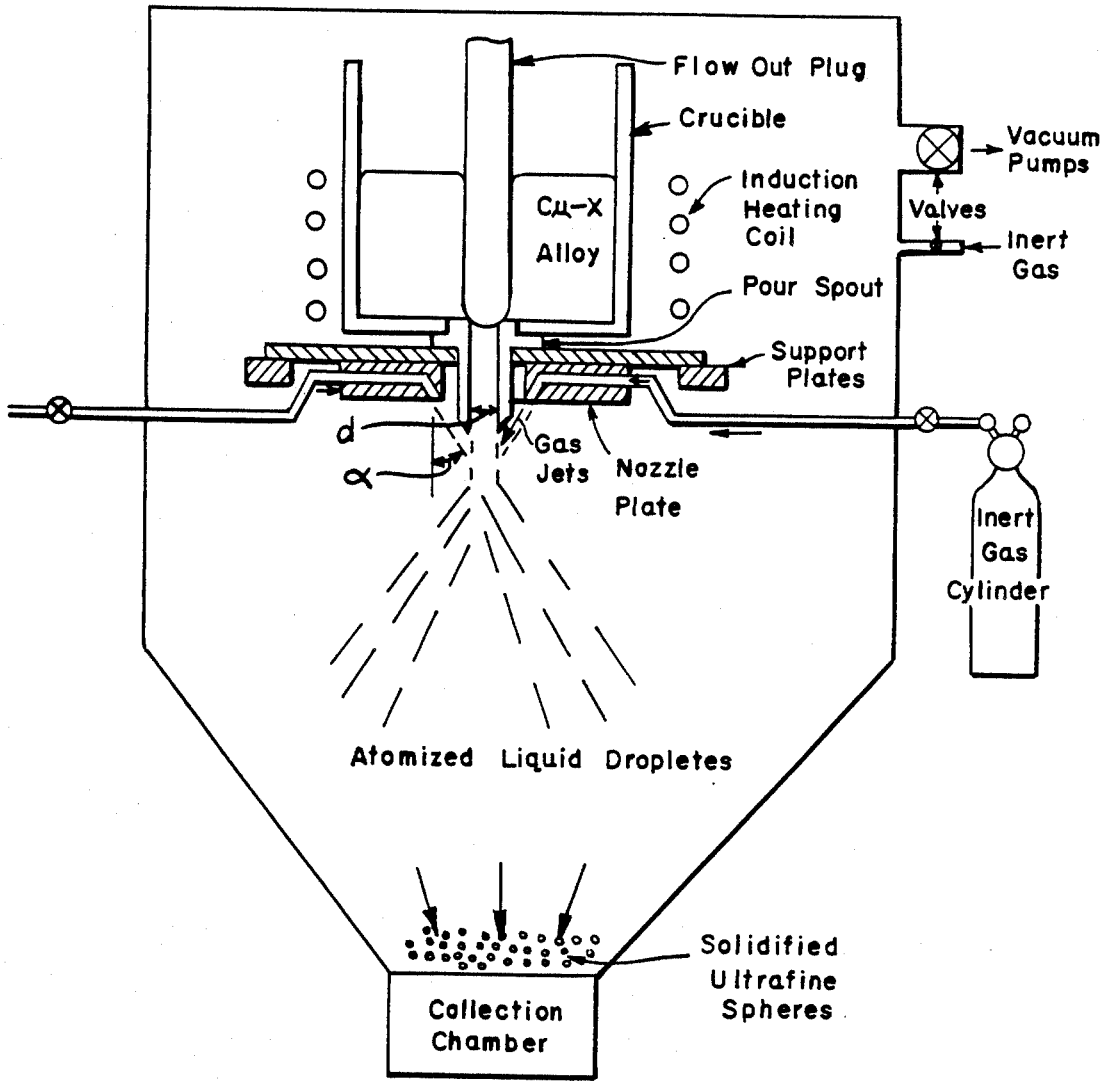
FIG. 2 is a diagrammatic elevational view of an atomization apparatus which may be used in practicing one embodiment of the method of this invention.

FIG. 2 illustrates an atomization apparatus that may be used in practicing this invention in one preferred embodiment. In this method the Cu-X alloy is melted in a crucible, and the melt is dispersed by inert gas jet atomization. For a description of similar metal atomization processes, reference may be had to the Metals Handbook, Vol. 7, "Powder Metallurgy", 9th ed. (1984), pages 25–39.

As indicated in FIG. 2, the Cu-X alloy in the crucible is melted by an induction heating coil, and is discharged through a pour sprout by lifting a flow-out plug. Surrounding the outlet passage are gas jet inlets provided in a nozzle plate. The inlets are connected to a source of inert gas under pressure. The gas is preferably argon. The atomized liquid droplets thus formed are cooled and solidified as they fall through the inert gas atmosphere and form spherical particles, which are collected in a suitable chamber.

The apparatus of FIG. 2 is particularly suitable for use with relatively non-reactive metals, viz. chromium, iron, cobalt, etc. More reactive metals may possibly become contaminated by reaction with the crucible material. However, the crucible can be formed of materials which are non-reactive or non-contaminating.

Figure 3:
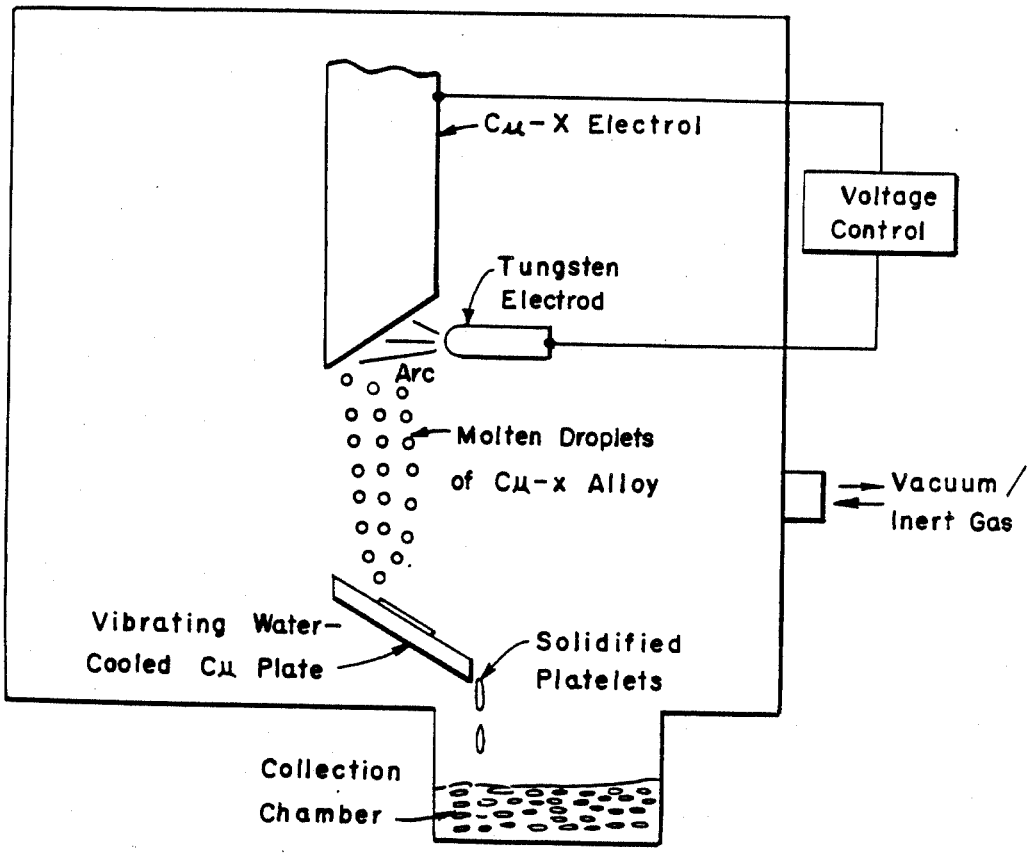
FIG. 3 is a diagrammatic elevational view of an electrode sputtering and platelet forming apparatus, comprising an alternate embodiment for practicing this invention.

An alternative apparatus is shown in FIG. 3. In this procedure, melting in a crucible is not required, thereby avoiding crucible contamination of reactive metals. The composite alloy is formed into an electrode, which is melted by an electric arc. Droplets are formed by sputtering from the melting electrode tip. Instead of solidifying the droplets in the surrounding atmosphere of inert gas, such as argon or helium, the droplets while still molten may be impinged on a cooled surface. For example, as indicated in FIG. 3, a vibrating water-cooled copper plate can be employed for this purpose. The solidified platelets thus formed fall into a collection chamber.

The apparatus of FIG. 3 may also be employed for depositing thin coatings of the Cu-X alloy on copper plates or copper cylinders, which can then be subjected to mechanical reduction. Procedures for carrying out this alternative process are described below in Examples IX and X.

It will be understood that prior to the operation of the apparatus of FIG. 2 or FIG. 3, the enclosing chambers are evacuated, and then filled with the inert gas.

While the diameters of the spheres produced by the apparatus of FIG. 2 or the diameters of the platelets produced by the apparatus of FIG. 3 can vary, it is preferred to produce the spheres in size ranges of diameters from 50 μm to 2000 μm, and the platelet thicknesses in the range of 100 to 2000 μm.

The method of this invention is further illustrated by the following specific examples.

EXAMPLE I

Cu-Nb spheres are prepared by an atomization process similar to the illustration of FIG. 2. Mixtures of Cu and Nb metals having % Nb in a preferred range of 10 to 20 wt % are placed in the crucible. The crucible material can be $ThO_2$ or $ZrO_2$ stabilized with $Y_2O_3$ or $Y_2O_3$ or Mo or W, where the preferred crucible materials are $ZrO_2$ or $Y_2O_3$. The large enclosure chamber is vacuum purged and filling to a pressure of 0.7 atm of inert gas is preferred. The induction coil is turned on and the metals melted and mixed by convection currents from the induction current plus natural convection. The flow out plug is lifted a controlled amount and the molten Cu-Nb alloy flows out the pour spout. At the same time Argon gas is introduced into the nozzle plate, causing the molten Cu-Nb stream to fly outward in a spray of fine molten droplets. The droplets solidify "in flight" and are deposited as solid spheres in the collection chamber, comprising a fine powder. The powders can be sized by passing through sieves. Sized-fractions giving the smallest Nb dendrites are compacted to cylindrical shapes by pressing in dies and/or by cold isostatic pressing. The resulting cylinders can be either extruded and drawn, swaged, or rolled to final form, or hot isostatically pressed followed by reduction to final size by any of extrusion, rolling, forging, swaging, or drawing. The droplet size of the atomized liquid is controlled by: gas velocity out of the nozzle, the angle $\alpha$, (indicated in FIG. 2), the diameter d (also indicated), and temperature of the molten bath. The preferred droplet size and corresponding particle sizes are in the range 50 to 2000 μm. The smallest obtainable dendrite size is related to selection of droplet size. Too small droplets (e.g., below 50 μm) may not produce Nb dendrites. Too large droplets (e.g., above 2000 μm) tend to produce too large dendrites.

EXAMPLE II

Following the procedure of Example I, Nb is replaced by Ta or V. The temperature of the molten alloy should be about 100° C. hotter (viz. 1800° C. instead of 1700° C.) for Ta, and about 100° cooler for V. The crucible may be formed of $Y_2O_3$.

EXAMPLE III

Following the procedure of Example I, Nb is replaced with Fe, Cr, or Co. The temperature of the molten alloys is lower, around 1600° C. The crucible material may be $Al_2O_3$.

EXAMPLE IV

Following the procedure of Example I, Nb is replaced with a mixture of Fe+Cr, or Fe+Co, or Co+Cr. The preferred range is 10 to 30 weight percent of Cr or Co in Fe. The molten alloy temperature is lower, around 1600° C. The crucible may be formed of $Al_2O_3$.

EXAMPLE V

Following the procedure of Example I, a prealloyed Cu-Nb alloy is charged into the crucible rather than the individual Cu and Nb metals. Alloying occurs before discharge and droplet dispersion.

EXAMPLE VI

A prealloyed Cu-Nb rod is placed in the chamber of FIG. 3 and the chamber is vacuum purged and backfilled with 0.7 atm of inert gas (Ar preferred). An arc is struck across the tungsten electrode and the ingot bottom, thereby slowly melting the Cu-Nb rod. Drops of molten Cu-Nb sputter from the rod tip and fall downwardly. The rod is lowered as it is consumed. The drops fall onto a vibrating, water-cooled copper plate, which causes rapid solidification, forming platelets. The vibration of the Cu plate moves the platelets down its slope and they are collected in a chamber. The platelets can be compacted into a cylindrical form by pressing in a die and/or cold isostatic pressing. These cylinders are then mechanically reduced as described in Example 1. Drop size can be controlled by the size of the W electrode and the Cu-Nb electrode, the voltage, and the current in the arc. These parameters are adjusted to produce drops giving a minimum mean dendrite size, preferred drop sizes are in the range of 0.1 to 1.5 mm. Dendrite sizes of the order of 0.2 μm are achievable.

EXAMPLE VII

Following the procedure of Example VI, the tungsten electrode is replaced by a Cu-Nb composite electrode. In this case, both electrodes can be identified as Cu-Nb alloy cylinders. The electrodes may be arranged perpendicularly, or placed horizontally. This modification eliminates the possibility of tungsten contamination, but usually some tungsten contamination is not harmful to the process.

EXAMPLE VIII

Following the procedures of Examples VI and VII, Nb is replaced by any one or a combination of V, Ta, Cr, Mo, W, Fe, or Co.

EXAMPLE IX

The procedure is identical to Example I except the collection chamber is modified as follows. Above the collection chamber shown in FIG. 2, a thin plate of water cooled Cu-X is placed below the diverging spray of liquid droplets, that is, close to the point of divergence of the spray. The molten dropets are thereby caused to solidify either directly on the thin plate, or to solidify partially in flight and finish solidification on the plate. Platelets can be formed rather than spherical particles. Alternatively, the cooled plate can be moved in a rectangular pattern so as to become uniformly coated with the solidified droplets. Following deposition of the Cu-Nb alloy the plate is removed, and reduced to sheet form by either hot or cold extrusion.

EXAMPLE X

The procedure is the same as Example IX, except the plate is replaced with a small diameter water cooled rod of Cu-X alloy. As deposition occurs the rod is rotated and translated thereby building up its diameter with the solidified droplets of Cu-X alloy. This cylinder is removed and reduced to wire by any of the mechanical reduction processes, extrusion, forging, rod rolling, swaging, or drawing.

While the foregoing examples have illustrated certain proportions of the dendritic metal to copper, such proportions may vary over a wide range, including from as little as one part by volume of dendritic metal to 99 parts by volume of copper up to as much as 50 parts dendritic metal to 50 parts by volume copper. In general, the range of dendritic metal in the alloy will be from about 5 to 39 volume percent.

REFERENCES

Bevk, et al. (1982), "In Situ Composites IV", Ed. Lempket et al., Elsevier Sci. Publ. Co., pages 121–133.
Downing, et al. (1987), *J. Appl. Phys.* 61:2621–2625.
Foner (1982), *Prog. Powder Met.* 38:107–114.
Bevk, et al. (1978), *J. Appl. Phys.*, 49:6031–6038.
Verhoeven et al. (1986), *J. Metals*, Sept. Issue, pp. 20–24.
Verhoeven, et al., U.S. Pat. No. 4,378,330.
Verhoeven, et al., U.S. Pat. No. 4,481,030.

We claim:

1. The method of preparing a copper-dendritic metal composite alloy for mechanical reduction to increase tensile strength, comprising:

(a) dispersing molten droplets of said composite alloy into an inert gas;

(b) solidifying said droplets in the form of spheres or platelets; and (c) compacting a mass of said spheres or platelets into an integrated body.

2. The method of claim 1 in which said dendritic metal is selected from the group consisting of vanadium, niobium, tantalum, chromium, molybdenum, tungsten, iron and cobalt, and combinations thereof.

3. The method of claim 1 in which said molten droplets are solidified to generally spherical particles while gas-borne.

4. The method of claim 1 in which said molten drops are solidified to platelets by impingement against a cooled surface.

5. The method of claims 1, 2, 3, or 4 in which said spheres have diameters in the range from 50 μm to 2000 μm, or said platelets have thicknesses in the range from 100 to 2000 μm.

6. The method of preparing a copper-dendritic metal composite alloy for mechanical reduction to increase tensile strength, the dendritic metal being selected from the group consisting of vanadium, niobium, tantalum, chromium, molybdenum, tungsten, iron and cobalt, and combinations thereof, comprising:

(a) dispersing molten droplets of said composite alloy into a gas by electric arc melting through an electrode formed from said alloy, the droplets of said alloy being splattered from the melting electrode into said inert gas;

(b) solidifying said droplets in the form of spheres or platelets; and (c) compacting a mass of said spheres or platelets into an integrated body.

7. The method of preparing a copper-dendritic metal composite alloy for mechanical reduction to increase tensile strength, said dendritic metal being selected from the group consisting of chromium, iron, cobalt, and combinations thereof, comprising:

(a) dispersing molten droplets of said composite alloy into an inert gas by melting said alloy in a crucible and dispersing the melt by inert gas jet atomization;

(b) solidifying said droplets in the form of spheres or platelets; and (c) compacting a mass of said spheres or platelets into an integrated body.

8. The method of preparing a copper-dendritic metal composite alloy for mechanical reduction to increase tensile strength, comprising:

(a) dispersing molten droplets of said composite alloy into a gas by electric arc melting through an electrode formed from said alloy, the droplets of said alloy being sputtered from the melting electrode into said inert gas;

(b) solidifying said droplets in the form of platelets by impinging the droplets against a cooled surface; and (c) compacting a mass of said platelets into an integrated body.

9. The method of claims 6, 7, or 8 in which the droplets formed in step (a) have diameters in the range from 50 to 2000 μm.

10. The method of claims 1, 6, 7, or 8 in which prior to step (c) the solidified spheres or platelets are selected by size, and the compacted mass in step (c) is a size selected mass.

11. The integrated bodies produced by the method of claims 1, 6, 7, or 8.

12. The method of preparing a copper-dendritic metal composite alloy comprising:

(a) dispersing molten droplets of said composite alloy into an inert gas;

(b) depositing said droplets as a coating on a copper plate or rod; and (c) subjecting the coated plate or rod to mechanical size reduction.

13. The method of preparing a copper-dendritic metal composite alloy, comprising:

(a) dispersing molten droplets of said composite alloy into an inert gas by melting said alloy in a crucible and dispersing the melt by inert gas jet atomization;

(b) depositing said droplets as a coating on a copper plate or rod; and (c) subjecting the coated plate or rod to mechanical size reduction.

14. The method of preparing a copper-dendritic metal composite alloy, comprising:

(a) dispersing molten droplets of said composite alloy into a gas by electric arc melting through an electrode formed from said alloy, the droplets of said alloy being sputtered from the melting electrode into said inert gas;

(b) depositing said droplets as a coating on a copper plate or rod; and (c) subjecting the coated plate or rod to mechanical size reduction.

* * * * *